US011097543B2

(12) United States Patent
Hiramoto et al.

(10) Patent No.: US 11,097,543 B2
(45) Date of Patent: Aug. 24, 2021

(54) LIQUID EJECTION HEAD AND METHOD FOR MANUFACTURING THE SAME

(71) Applicant: CANON KABUSHIKI KAISHA, Tokyo (JP)

(72) Inventors: Atsushi Hiramoto, Machida (JP); Takayuki Teshima, Yokohama (JP); Tamaki Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/592,445

(22) Filed: Oct. 3, 2019

(65) Prior Publication Data

US 2020/0122465 A1 Apr. 23, 2020

(30) Foreign Application Priority Data

Oct. 17, 2018 (JP) ..... JP2018-195929

(51) Int. Cl.
*B41J 2/14* (2006.01)
*B41J 2/16* (2006.01)

(52) U.S. Cl.
CPC ..... *B41J 2/1433* (2013.01); *B41J 2/162* (2013.01); *B41J 2/1626* (2013.01); *B41J 2002/14491* (2013.01)

(58) Field of Classification Search
None
See application file for complete search history.

(56) References Cited

U.S. PATENT DOCUMENTS

2003/0081069 A1* 5/2003 Kim ..... B41J 2/1631 347/56
2011/0012960 A1* 1/2011 Sakuma ..... B41J 2/14129 347/44
2014/0063690 A1* 3/2014 Masuda ..... H01G 4/236 361/321.5

FOREIGN PATENT DOCUMENTS

JP 2012-051110 A 3/2012
JP 2012051110 A * 3/2012

* cited by examiner

*Primary Examiner* — Erica S Lin
*Assistant Examiner* — Tracey M McMillion
(74) *Attorney, Agent, or Firm* — Venable LLP

(57) ABSTRACT

In a substrate of a liquid ejection head, there are formed a first through-hole which constitutes a liquid supply path, and a second through-hole in which a through-hole electrode electrically connected to a wiring layer is formed on the inner surface. The first through-hole has a first hole having a first opening and a second hole having a second opening, and the second through-hole has a third hole having a third opening and a fourth hole having a fourth opening. When the minimum width of the first opening is represented by D1, the minimum width of the second opening is represented by D2, the minimum width of the third opening is represented by D3, and the minimum width of the fourth opening is represented by D4, the first to fourth openings satisfy a relation of D1>D3>D4>D2.

16 Claims, 6 Drawing Sheets

LIQUID EJECTION HEAD AND METHOD FOR MANUFACTURING THE SAME

BACKGROUND OF THE INVENTION

Field of the Invention

The present invention relates to a liquid ejection head and a method for manufacturing the same.

Description of the Related Art

A liquid ejection head is known which ejects a liquid such as ink from an ejection port to record an image on a recording medium. In recent years, there has been a strong demand for a liquid ejection head to improve a quality of an image, and for this purpose, it is important to make a droplet land on a position on a recording medium, onto which the droplet should originally land, with high accuracy. In order to improve a landing accuracy of the droplet, a distance between a plane of the ejection port at which the ejection port of the liquid ejection head is opened and a recording medium can be made as short as possible. However, in a thermal type liquid ejection head that ejects the liquid by using thermal energy, a bonding wire is used as a wire for supplying an electric signal and an electric power therethrough to an energy generating element, and accordingly there is a limit in a distance between the plane of the ejection port and the recording medium, which can be shortened. Specifically, the bonding wire and a sealing material for protecting the bonding wire from the ink protrude from the plane of the ejection port to a recording medium side, and accordingly it is necessary to ensure such a distance between the plane of the ejection port and the recording medium that this portion does not interfere with the recording medium.

Then, it is conceivable to use a through-hole electrode (electrode penetrating through substrate) which is employed in a three-dimensional mounting technology, also in the liquid ejection head, as a configuration for supplying the electric signal and the electric power, to the energy generating element. Due to such a through-hole electrode, a wiring layer provided on a surface (face opposite to ejection port of liquid ejection head) side of the substrate can be routed to the back surface side of the substrate, and it becomes unnecessary to provide the bonding wire on the surface side, which hinders shortening of the distance between the plane of the ejection port and the recording medium.

Japanese Patent Application Laid-Open No. 2012-51110 describes a method for forming a through-hole electrode on a substrate for a liquid ejection head. In this method, lower wiring is formed on the surface side of the substrate by metal sputtering, then the substrate is etched from the back surface side, and a through hole for the through-hole electrode and a through hole for a liquid supply path are formed. Then, an upper electrode and the through-hole electrode are formed on the back surface of the substrate and the inner surface of the through hole for the through-hole electrode, respectively, by metal plating, and the upper wiring and the lower wiring are conducted to each other via the through-hole electrode.

Along with a miniaturization of a substrate (chip shrinkage), a circuit and wiring are densely formed on the substrate, and the through hole for the through-hole electrode can be formed to have a diameter as small as possible, so as not to interfere with the circuit and the wiring. However, when the diameter of the through hole decreases, the wiring resistance of the through-hole electrode formed on the inner surface increases, and the energy efficiency results in decreasing. Accordingly, the through hole for the through-hole electrode can be formed in consideration of the balance between the decrease of the wiring resistance and the chip shrinkage. On the other hand, the through hole for the liquid supply path can be opened as small as possible on the surface side of the substrate in order that the ejection ports are arranged in high density, but on the back surface side of the substrate, can be opened larger than that on the surface side, in order to decrease the flow resistance and rapidly supply the liquid.

As described above, the through hole for the through-hole electrode and the through hole for the liquid supply path have shapes and dimensions suitable for their respective functions. However, in the method described in Japanese Patent Application Laid-Open No. 2012-51110, two through holes having the same depth are formed from the back surface side of the substrate; and accordingly the opening width of each through hole becomes the same on the surface side, and becomes the same also on the back surface side. In other words, in the method described in Japanese Patent Application Laid-Open No. 2012-51110, it is difficult to simultaneously realize the optimum shape and dimension for each through hole.

SUMMARY OF THE INVENTION

Then, an object of the present invention is to provide a liquid ejection head that achieves both the decrease of the wiring resistance of the through-hole electrode and the decrease of the flow resistance of the liquid supply path while achieving the miniaturization of the substrate; and a method for manufacturing the same.

In order to achieve the above object, a liquid ejection head of the present invention includes:

a substrate having a first plane, and a second plane of another side of the first plane; an ejection port forming member that is provided on a side of the second plane of the substrate and has an ejection port formed therein which ejects a liquid therethrough; and a wiring layer provided between the substrate and the ejection port forming member, wherein in the substrate, a first through hole and a second through hole are formed that penetrate through the substrate, the first through hole constitutes a supply path which communicates with the ejection port and supplies the liquid to the ejection port, and a through-hole electrode which is electrically connected to the wiring layer is formed on an inner surface of the second through hole, wherein the first through hole has a first hole which has a first opening in the first plane, and a second hole which has a second opening in the second plane, and communicates with the first hole; the second through hole has a third hole which has a third opening in the first plane, and a fourth hole which has a fourth opening in the second plane and communicates with the third hole; and when a minimum width of the first opening along a straight line which passes through a center of the first opening and is parallel to the first plane is represented by D1, a minimum width of the second opening along a straight line which passes through a center of the second opening and is parallel to the second plane is represented by D2, a minimum width of the third opening along a straight line which passes through a center of the third opening and is parallel to the first plane is represented by D3, and a minimum width of the fourth opening along a straight line which passes through a center of the fourth opening and is parallel to the second plane is represented by D4, the first to fourth openings satisfy a relation of: D1>D3>D4>D2.

In such a liquid ejection head and a method for manufacturing the same, in the first through hole, the opening width (minimum width) of the second hole can be made as small as possible while the opening width (minimum width) of the first hole is made as large as possible. On the other hand, in the second through hole, the opening width (minimum width) of the fourth hole can be made as large as possible while the opening width (minimum width) of the third hole is made as small as possible.

According to the present invention, both the reduction of the wiring resistance of the through-hole electrode and the reduction of the flow resistance of the liquid supply path can be achieved while the miniaturization of the substrate is achieved.

Further features of the present invention will become apparent from the following description of exemplary embodiments with reference to the attached drawings.

DESCRIPTION OF THE EMBODIMENTS

Embodiments of the present invention will be described below with reference to the drawings. However, the present invention is not limited to the following embodiments.

First Embodiment

Figure 1A:
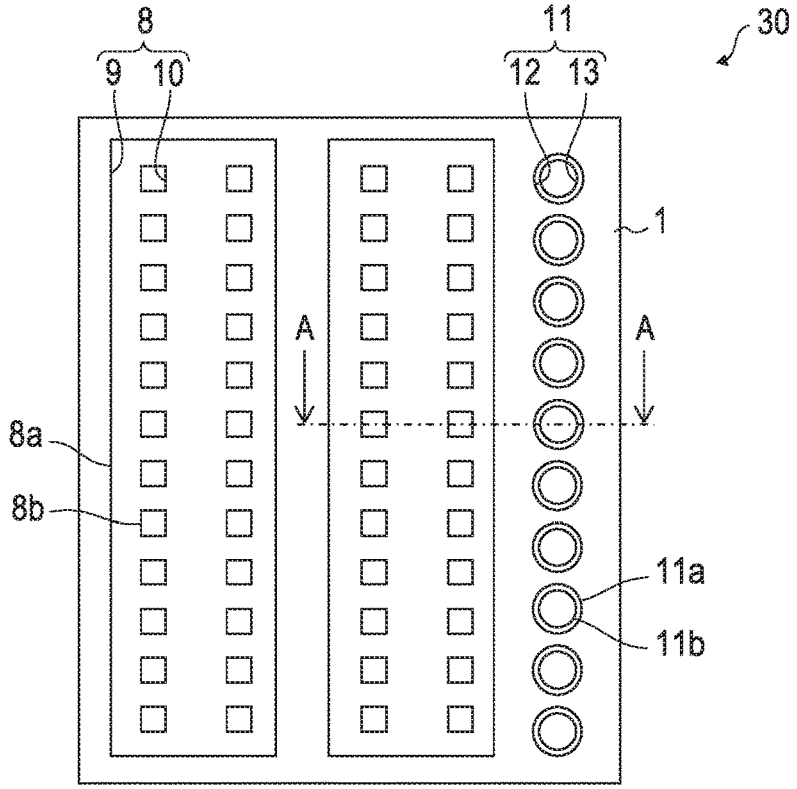
FIGS. 1A and 1B illustrate a schematic view showing a liquid ejection head according to a first embodiment.
Figure 1B:
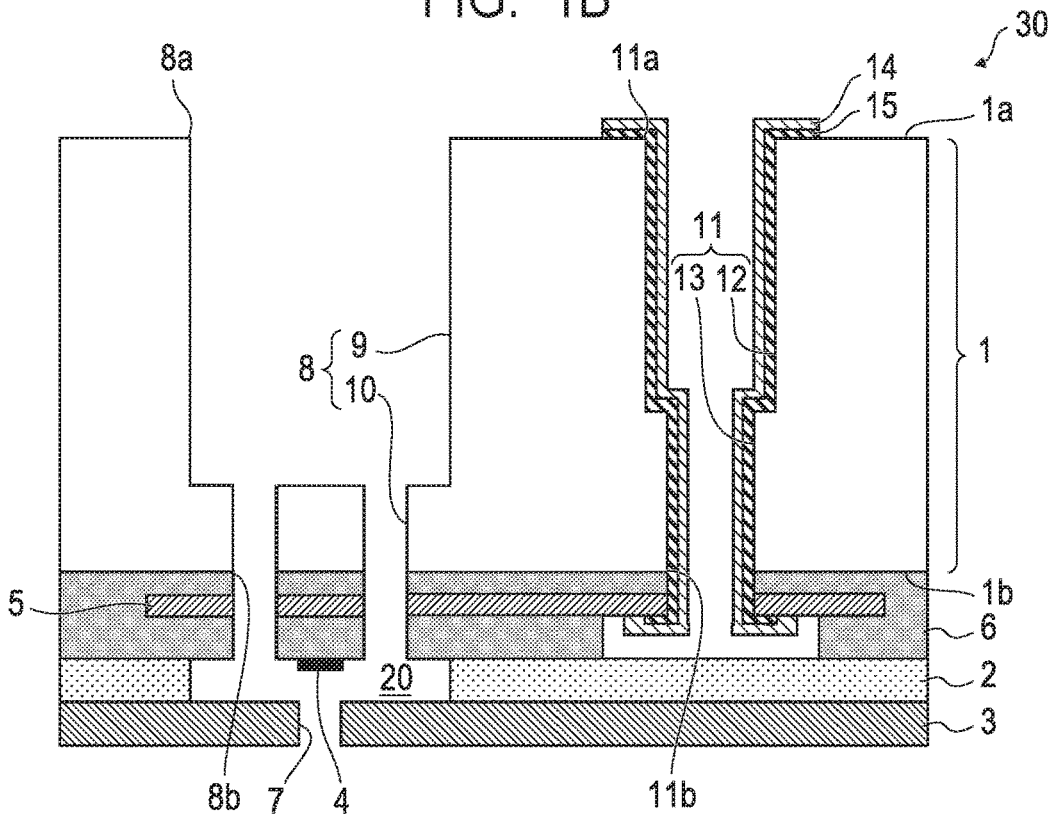

FIG. 1A illustrates a schematic plan view of a liquid ejection head according to a first embodiment of the present invention, which is viewed from the back surface side of a substrate. FIG. 1B shows a schematic cross-sectional view taken along the line A-A of FIG. 1A.

A liquid ejection head 30 has a substrate 1 formed from silicon, a flow path forming member 2, an ejection port forming member 3, an energy generating element 4, a wiring layer 5 and an insulating protective film 6.

The substrate 1 has a back surface (hereinafter also referred to as "substrate back surface") 1*a*, and a surface (hereinafter also referred to as "substrate surface") 1*b*; and the flow path forming member 2 and the ejection port forming member 3 are provided in this order on the substrate surface 1*b*, via the insulating protective film 6. In the ejection port forming member 3, a plurality of ejection ports 7 for discharging the liquid therethrough are formed, and on the face opposite to the recording medium (face of the other side of face opposite to substrate 1), a liquid repellent layer (not shown) is formed in order to improve an ejection performance. In the flow path forming member 2, a plurality of flow paths 20 are formed which communicate with the plurality of ejection ports 7. The energy generating element 4 is an element which generates energy to be used for discharging the liquid, and is provided at a position opposite to the ejection port 7, in each flow path 20. The energy generating element 4 includes an electrothermal transducer (heater) and a piezo element. The wiring layer 5 is provided between the substrate 1 and the flow path forming member 2, and is electrically connected to the energy generating element 4 in order to supply an electric signal and an electric power to the energy generating element 4. The liquid in the flow path 20 can be foamed and ejected from the ejection port 7 by thermal energy which the energy generating element 4 generates. The insulating protective film 6 is provided so as to insulate the substrate 1 from the wiring layer 5. An adhesion layer (not shown) is provided between the insulating protective film 6 and the flow path forming member 2, in order to strengthen the adhesion between the film and the member.

In the substrate 1, two types of through holes are formed which penetrate the substrate 1. The first through hole 8 constitutes a liquid supply path which communicates with the ejection port 7 and supplies the liquid to the ejection port 7, and the second through hole 11 is provided so as to form a through-hole electrode 14 electrically connected to the wiring layer 5 therein, on its inner circumferential surface (inner surface).

The first through hole 8 includes a first hole 9, and a plurality of second holes 10 which communicate with the first hole 9. The second hole 10 constitutes an individual supply path which communicates with the ejection port 7 via the flow path 20, and supplies the liquid to the ejection port 7; and the first hole 9 constitutes a common supply path for supplying the liquid to the plurality of individual supply paths (second holes) 10. Thus, the liquid which flows in the common supply path (first hole) 9 can be supplied to the respective flow paths 20 via the individual supply paths (second holes) 10. The first hole 9 can be formed in a thin groove shape on the substrate back surface 1*a*, along a direction (vertical direction in FIG. 1A) in which the ejection ports 7 are arrayed, in order to supply the liquid to the plurality of ejection ports 7, as the common supply path. A plurality of first holes 9 are provided in parallel in a direction (left and right direction in FIG. 1A) perpendicular to the direction in which the ejection ports 7 are arrayed, and on the bottom face of each of the first holes 9, a plurality of second holes 10 are arranged in two rows along the direction in which the ejection ports 7 are arrayed. Two second holes 10 are provided for one flow path 20.

The second through hole 11 is formed of a third hole 12, and a fourth hole 13 which communicates with the third hole 12. The through-hole electrode 14 is provided on the inner circumferential surface of the second through hole 11 via an insulating layer 15. The through-hole electrode 14 is electrically connected to both of the wiring layer 5 and an electrode pad (not shown) provided on the substrate back surface 1*a*. The electrode pad is electrically connected to a drive power supply (not shown), and thereby can supply the electric signal and the electric power from the drive power supply to the energy generating element 4 through the through-hole electrode 14. A plurality of second through holes 11 are provided along a direction in which the ejection ports 7 are arrayed.

Figure 2A:
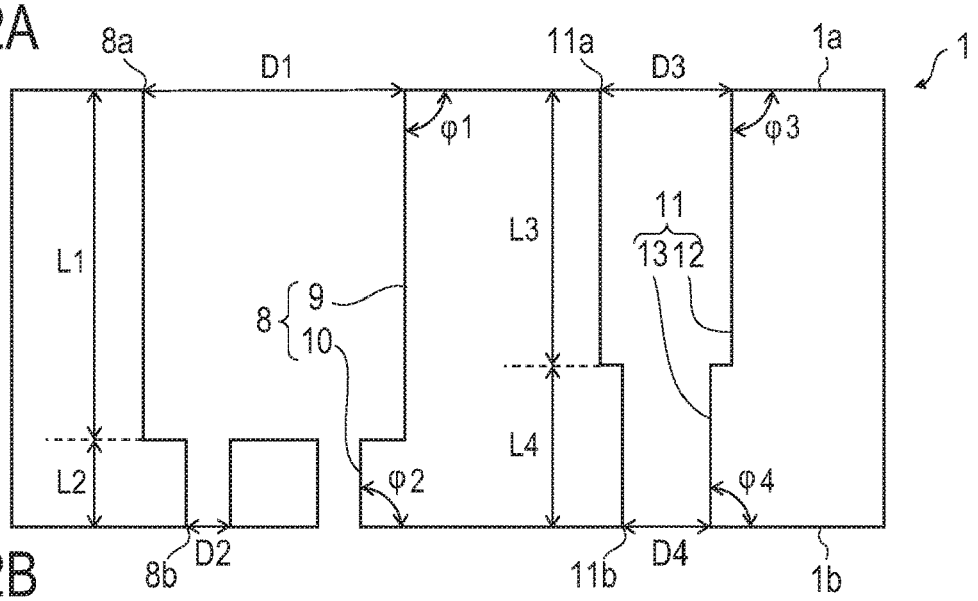
FIGS. 2A, 2B and 2C illustrate a schematic cross-sectional view showing a substrate of the liquid ejection head according to the first embodiment.

Here, with reference to FIG. 2A, a configuration of the substrate of the present embodiment, in particular, a configuration of two through holes will be described in detail. FIG. 2A shows a schematic cross-sectional view of the substrate of the liquid ejection head illustrated in FIG. 1B.

In the first through hole 8, the first hole 9 has the first opening 8*a* on the substrate back surface (first plane) 1*a*, and the second hole 10 has a second opening 8*b* on the substrate surface (second plane) 1*b*. In the second through hole 11, the third hole 12 has the third opening 11*a* on the substrate back surface 1*a*, and the fourth hole 13 has the fourth opening 11*b* on the substrate surface 1*b*. The first and second through holes 8 and 11 are formed in the substrate 1 so that the first to fourth openings 8*a*, 8*b*, 11*a* and 11*b* satisfy relations of $$D1>D2,\ D3>D4,\ D1>D3,\ \text{and}\ D4>D2.$$

Here, D1 is the minimum width of the first opening 8*a*, and means the smallest width in the widths of the first opening 8*a*, which have been measured along a straight line that passes through the center of gravity (center) of the first opening 8*a* and is parallel to the substrate back surface 1*a*. D2 is the minimum width of the second opening 8*b*, and means the smallest width in the widths of the second opening 8*b*, which have been measured along a straight line that passes through the center of gravity (center) of the second opening 8*b* and is parallel to the substrate surface 1*b*. D3 is the minimum width of the third opening 11*a*, and means the smallest width in the widths of the third opening 11*a*, which have been measured along a straight line that passes through the center of gravity (center) of the third opening 11*a* and is parallel to the substrate back surface 1*a*. D4 is the minimum width of the fourth opening 11*b*, and means the smallest width in the widths of the fourth opening 11*b*, which have been measured along a straight line that passes through the center of gravity (center) of the fourth opening 11*b* and is parallel to the substrate surface 1*b*. In addition, in the present embodiment, the minimum width D1 corresponds to a length of the short side of the first opening 8*a* which is a rectangle, and the minimum width D2 corresponds to a length of one side of the second opening 8*b* which is a square. In addition, the minimum widths D3 and D4 correspond to the diameters of the third opening 11*a* and the fourth opening 11*b*, respectively, which are circles. However, the shapes of the first to fourth openings 8*a*, 8*b*, 11*a* and 11*b* are not limited to these shapes as will be described later.

To summarize the above description, the first through hole 8 has different opening widths (minimum widths) D1 and D2 between the substrate back surface 1*a* and the substrate surface 1*b*, and the second through hole 11 also has different opening widths (minimum widths) D3 and D4 between the substrate back surface 1*a* and the substrate surface 1*b*. In addition, the first through hole 8 and the second through hole 11 have different opening widths (minimum widths) D1 and D3 on the substrate back surface 1*a*, and have different opening widths (minimum widths) D2 and D4 also on the substrate surface 1*b*. Accordingly, in the first through hole 8, the opening width (minimum width) D2 of the second hole (individual supply path) 10 can be made as small as possible, while the opening width (minimum width) D1 of the first hole (common supply path) 9 is made as large as possible. On the other hand, in the second through hole 11, the opening width (minimum width) D4 of the fourth hole 13 can be made as large as possible, while the opening width (minimum width) D3 of the third hole 12 is made as small as possible.

Because of this, in the first through hole 8, the densification of the ejection ports 7, and consequently the miniaturization of the substrate 1 can be achieved, while the reduction of the flow resistance of the liquid is achieved; and in the second through hole 11, the miniaturization of the substrate 1 can be achieved while the reduction of the wiring resistance of the through-hole electrode 14 is achieved. As a result, both the reduction of the wiring resistance of the through-hole electrode 14 and the reduction of the flow resistance of the liquid supply paths 9 and 10 can be achieved, while the miniaturization of the substrate 1 is achieved. Furthermore, although the details will be described later, the cost and the number of steps for forming the first and second through holes 8 and 11 can be reduced by the above configuration.

Furthermore, a first angle $\phi$1 which is formed by an inner surface of the first hole 9 and the substrate back surface 1*a*, and a second angle $\phi$2 which is formed by an inner surface of the second hole 10 and the substrate surface 1*b* are both right angles. In other words, because the first and second angles $\phi$1 and $\phi$2 are right angles, the first through hole 8 does not protrude outward in a radial direction of the first opening 8*a*. In addition, the third angle $\phi$3 which is formed by an inner surface of the third hole 12 and the substrate back surface 1*a*, and the fourth angle $\phi$4 which is formed by an inner surface of the fourth hole 13 and the substrate surface 1*b* each is also a right angle. In other words, because the third and fourth angles $\phi$3 and $\phi$4 are right angles, the second through hole 11 does not protrude outward in a radial direction of the third opening 11*a*. As a result, the first through holes 8 and the second through holes 11 can be arranged at a higher density, and the substrate 1 can be further miniaturized.

Figure 2B:
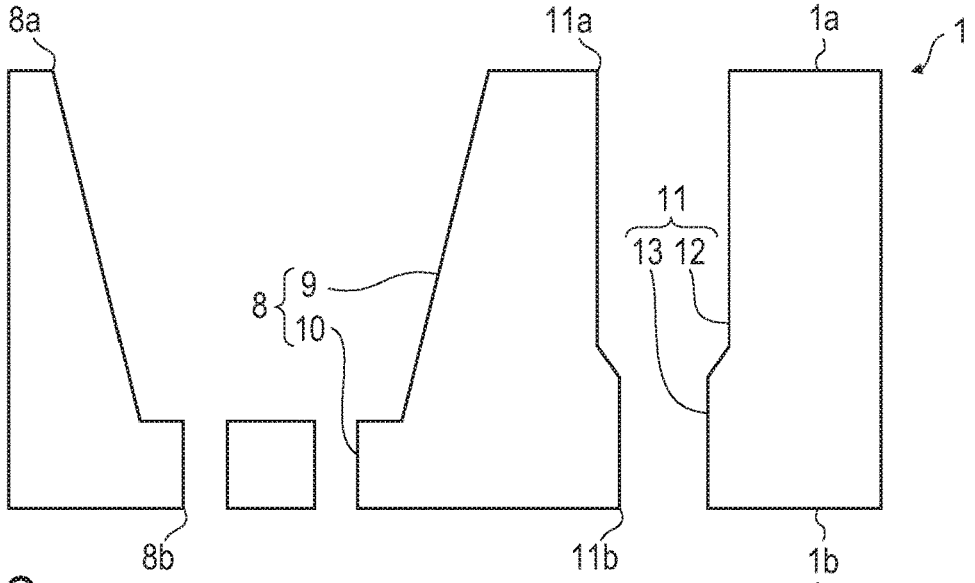
Figure 2C:
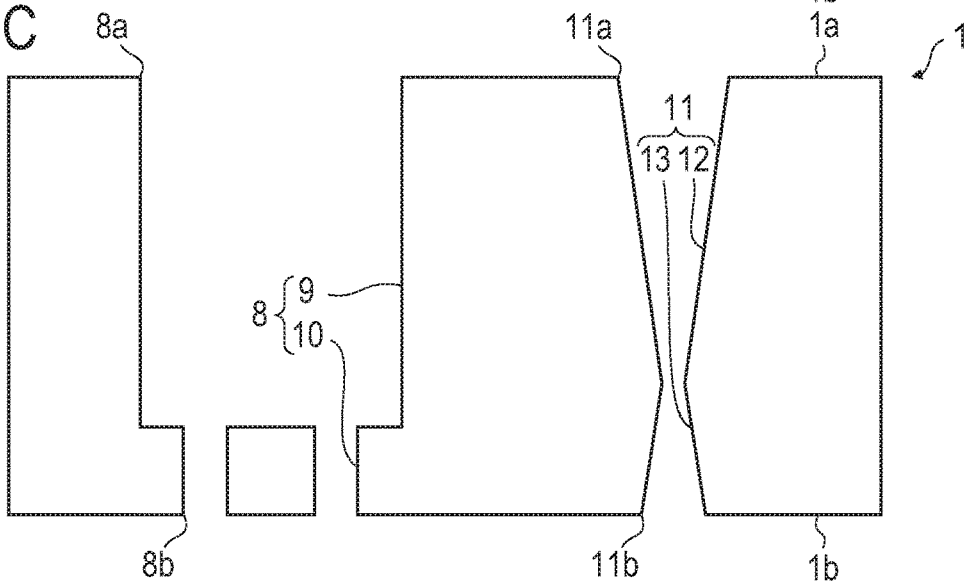

In addition, from the viewpoint of the miniaturization of the substrate 1, the first through hole 8 and the second through hole 11 may not protrude outward in radial directions of the first opening 8*a* and the third opening 11*a*, respectively, and at least one of the first to fourth angles $\phi$1 to $\phi$4 may be an obtuse angle. For example, as illustrated in FIG. 2B, the first angle $\phi$1 may be an obtuse angle, and in the case, the first hole 9 becomes a tapered shape in which the opening diameter decreases as the depth increases. In addition, as illustrated in FIG. 2C, both the third and fourth angles $\phi$3 and $\phi$4 may be obtuse angles. In this case, the second through hole 11 becomes such a tapered shape that the opening diameter decreases as the depth of the third hole 12 increases, and the opening diameter decreases as the depth of the fourth hole 13 increases.

However, assuming that the minimum width D1 of the first openings 8*a* is the same, when the first angle $\phi$1 is a right angle, the cross-sectional area of the first hole 9 in a thickness direction of the substrate 1 can be increased, compared to the case in which the first angle $\phi$1 is an obtuse angle. In addition, assuming that the minimum width D2 of the second openings 8*b* is the same, when the second angle $\phi$2 is a right angle, the cross-sectional area of the second hole 10 in the thickness direction of the substrate 1 can be increased, compared to the case in which the second angle $\phi$2 is an obtuse angle. As a result, the flow resistance of the liquid can be reduced, which is generated when the first through hole 8 is used as the liquid supply path, and the function of the first through hole 8 can be improved. Similarly, assuming that the minimum width D3 of the third opening 11*a* is the same, when the third angle $\phi$3 is a right angle, the cross-sectional area of the third hole 12 in the thickness direction of the substrate 1 can be increased, compared to the case in which the third angle $\phi$3 is an obtuse angle. In addition, assuming that the minimum width D4 of the fourth opening 11*b* is the same, when the fourth angle ϕ4 is a right angle, the cross-sectional area of the fourth hole 13 in the thickness direction of the substrate 1 can be increased, compared to the case in which the fourth angle ϕ4 is an obtuse angle. As a result, as will be described later, the wiring resistance of the through-hole electrode 14 can be reduced which is formed on the inner surface of the second through hole 11, and the function of the through-hole electrode 14 can be improved.

For this reason, the first through fourth angles ϕ1 to ϕ4 can all be right angles. Here, the term "right angle" means not only strictly 90°, but also an angle slightly deviated from a right angle within a range of processing accuracy.

Figure 3A:
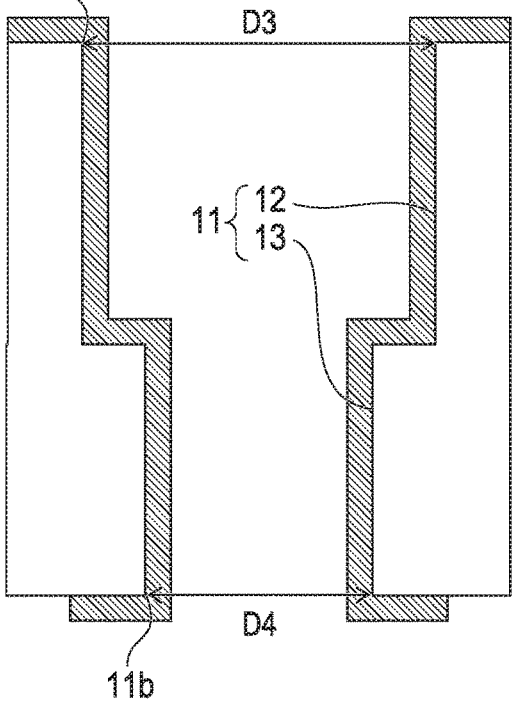
FIGS. 3A, 3B and 3C illustrate a schematic view showing a second through hole of the liquid ejection head according to the first embodiment.
Figure 3B:
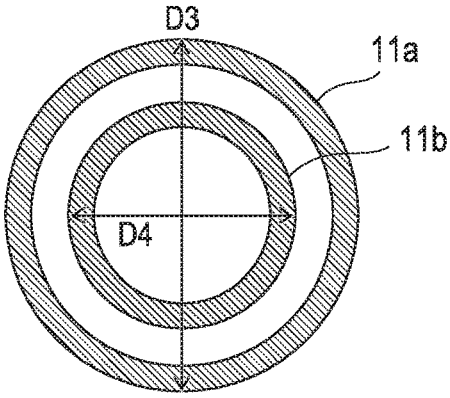
Figure 3C:
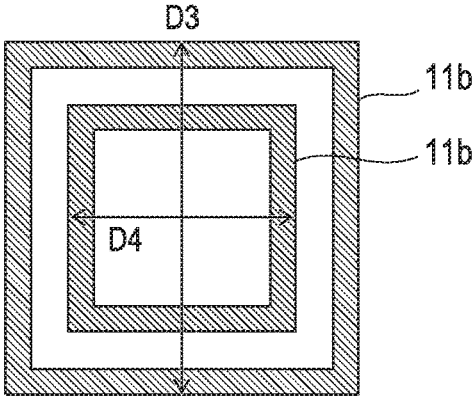

As long as the first through hole 8 penetrates the substrate 1 and functions as a through hole for the liquid supply path, shapes of the first and second openings 8*a* and 8*b* are not limited in particular. For example, the second opening 8*b* may be a rectangle or a circle. Similarly, as long as the second through hole 11 penetrates the substrate 1 and functions as the through hole for the through-hole electrode, shapes of the third and fourth openings 11*a* and 11*b* are not limited in particular. In the present embodiment, as illustrated in FIGS. 3A and 3B, the third hole 12 is formed into a cylindrical shape, and the fourth hole 13 is formed into a cylindrical shape coaxial with the third hole 12. Because of this, the third opening 11*a* is a circle of which the diameter is equal to the minimum width D3, and the fourth opening 11*b* is a circle of which the diameter is equal to the minimum width D4, but the openings may be another geometric shape. In this regard, when the resistivity of the wiring is represented by ρ, a length is represented by 1 and a cross-sectional area is represented by S, the wiring resistance R of the wiring (through-hole electrode) formed on the inner surface of the through hole is expressed by R=ρ(1/S). Accordingly, when the thickness and the length of the wiring each is equal, the wiring resistance can be reduced by the increase of the cross-sectional area. Because of this, the third opening 11*a* can have a shape having a circumferential length equal to or longer than the circumference which has the minimum width D3 as a diameter, and the fourth opening 11*b* can have a shape having a circumferential length equal to or longer than a circumference which has the minimum width D4 as a diameter. Such shapes include squares which have the minimum widths D3 and D4 as the length of one side, as illustrated in FIG. 3C, and rectangles which have the minimum widths D3 and D4 as the length of the short side.

Figure 4A:
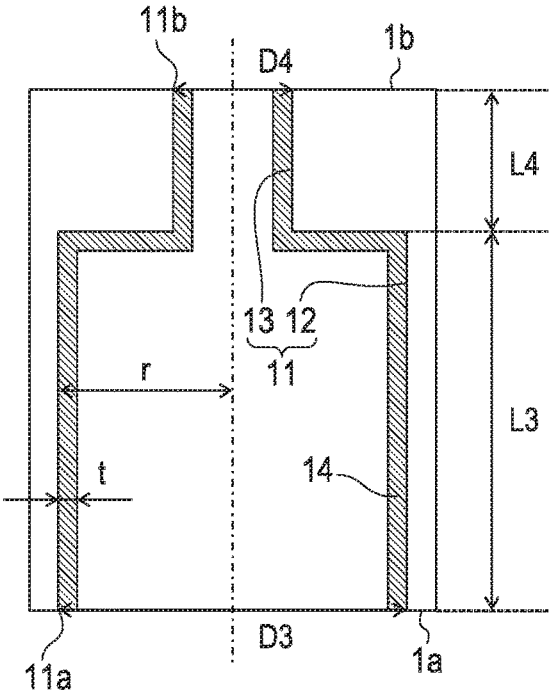
FIGS. 4A and 4B illustrate a schematic cross-sectional view for describing a wiring resistance of a through-hole electrode of the first embodiment.
Figure 4B:
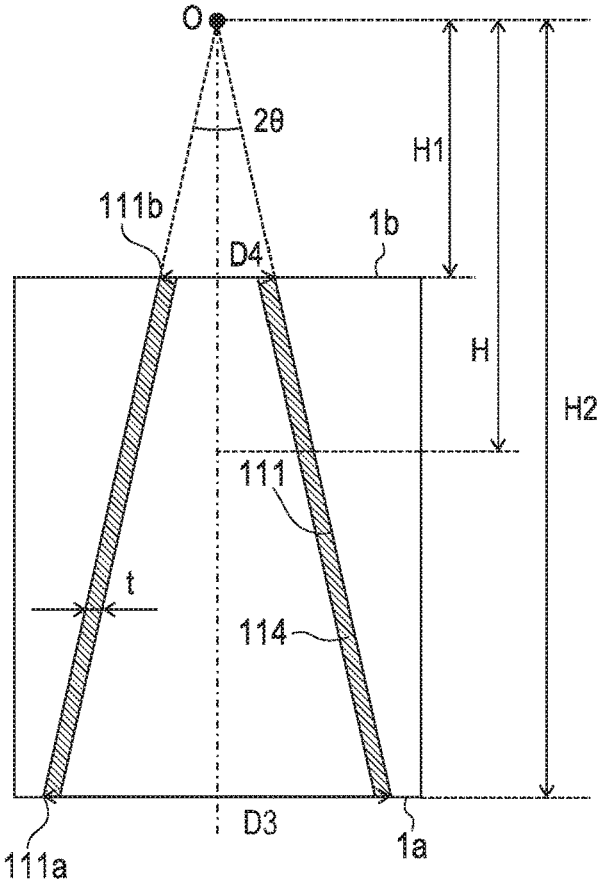

In the second through hole 11 of the present embodiment, the wiring resistance of the through-hole electrode 14 can be reduced which is formed on the inner circumferential surface, compared to the case of a conventional through hole having a taper-shaped inner circumferential surface. The above description will be described below with reference to FIGS. 4A and 4B. FIG. 4A illustrates a schematic sectional view of the second through hole of the present embodiment; FIG. 4B illustrates a schematic sectional view of the conventional through hole which has the taper-shaped inner circumferential surface; and both illustrate a cross section containing the central axis of the through hole.

In the present embodiment illustrated in FIG. 4A, when a radius of the second through hole 11 is represented by r, a depth of the third hole 12 is represented by L3 and a depth of the fourth hole 13 is represented by L4, the wiring resistance $R_1$ of the through-hole electrode 14 which has been formed on the inner circumferential surface of the second through hole 11 can be expressed in the following way.

$$R_1 = \rho\frac{L3}{\pi t(D3-t)} + \rho\frac{L4}{\pi t(D4-t)} + \int_{\frac{D3}{2}-t}^{\frac{D4}{2}-t}\frac{\rho dr}{2\pi rt}$$

On the other hand, suppose that a conventional through hole 111 illustrated in FIG. 4B is a taper-shaped through hole that has a circular back surface opening 111*a* which has the same diameter D3 as the third opening 11*a*, and has a circular surface opening 111*b* which has the same diameter D4 as the fourth opening 11*b*. A wiring resistance $R_0$ of a through-hole electrode 114 which has been formed on an inner circumferential surface of such a through hole 111 can be expressed in the following way.

$$R_0 = \int_{H1}^{H2}\frac{4\rho dH}{\pi[(2H\tan\theta)^2 - 4(H\tan\theta - t)^2]}$$

Here, 2θ is a vertex angle of such a virtual cone that the side surface of a circular truncated cone which has the back surface opening 111*a* as a bottom face and the surface opening 111*b* as the top face is extended to a side of the surface opening 111*b*. In addition, H1 and H2 are distances from a vertex O of the virtual cone to the surface opening 111*b* and to the back surface opening 111*a*, respectively, and H is a distance from the vertex O along a perpendicular line drawn from the vertex O to the back surface opening 111*a*.

Accordingly, in the second through hole 11 of the present embodiment illustrated in FIG. 4A, the depth L3 of the third hole 12 is adjusted so as to satisfy the following relation, and thereby the wiring resistance of the through-hole electrode 14 formed on the inner circumferential surface can be reduced, compared to the conventional through hole.

$$\int_{H1}^{H2}\frac{4\rho dH}{\pi[(2H\tan\theta)^2 - 4(H\tan\theta - t)^2]} < \rho\frac{L3}{\pi t(D3-t)} + \rho\frac{L4}{\pi t(D4-t)} + \int_{\frac{D3}{2}-t}^{\frac{D4}{2}-t}\frac{\rho dr}{2\pi rt}$$

In the present embodiment, a liquid which is supplied to the flow path 20 passes from one first hole (common supply path) 9 to two second holes (individual supply paths) 10, and flows into one flow path 20, but the method for supplying the liquid to the flow path 20 is not limited to the above method. For example, it is acceptable to divide the first hole 9 into two in a direction (left and right direction in FIG. 1A) perpendicular to a direction in which the ejection ports 7 are arrayed, to make one hole communicate with a flow path 20 via one of the second holes 10, and to make the other hole communicate with the flow path 20 via the other second hole 10. Thereby, a liquid is supplied from the one second hole 10 to the flow path 20, and the liquid in the flow path 20 is recovered from the other second hole 10; and thereby a forcible flow (circulating flow) of the liquid can also be generated in the flow path 20. In other words, the liquid inside the flow path 20 can also be circulated between the flow path 20 and the outside. This structure suppresses the thickening of the liquid due to water evaporation in the vicinity of the ejection port 7, and reduces the possibilities that an ejection speed decreases and a concentration of a color material changes, which is advantageous in a point that thereby the lowering of a quality of a recorded image can be suppressed.

Next, a method for manufacturing the liquid ejection head of the present embodiment will be described with reference to FIGS. 5A to 5H. FIGS. 5A to 5H illustrate a schematic cross-sectional view of the liquid ejection head in each step of the manufacturing method of the present embodiment, and a view corresponding to FIG. 1B.

Figure 5A:
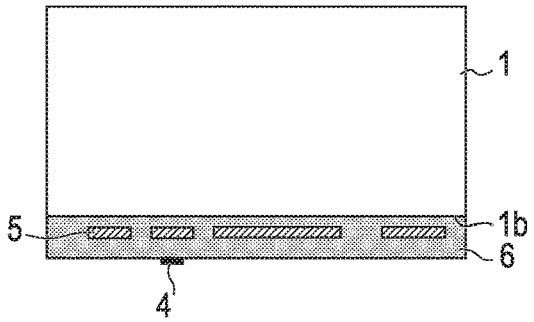
FIGS. 5A, 5B, 5C, 5D, 5E, 5F, 5G and 5H illustrate a schematic cross-sectional view showing a method for manufacturing the liquid ejection head according to the first embodiment.

Firstly, as illustrated in FIG. 5A, the substrate 1 is prepared which has the energy generating element 4, the wiring layer 5, the insulating protective film 6 and the adhesion layer (not shown) provided on the surface 1*b*, and is formed from silicon. The energy generating element 4 is arranged in a region opposite to the position at which the ejection port 7 is formed in a step that will be described later, and the wiring layer 5 and the adhesion layer are arranged in a region in which the first through hole 8 and the second through hole 11 are not formed in a step that will be described later.

Figure 5B:
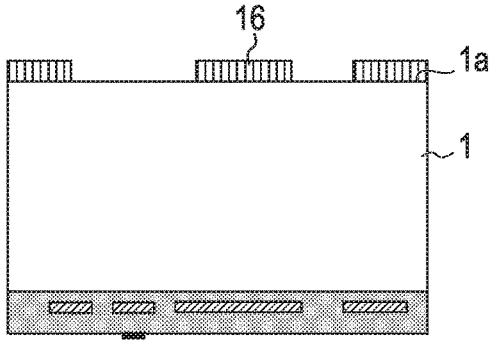

Next, as illustrated in FIG. 5B, a first etching mask 16 for forming the first hole 9 and the third hole 12 is formed on the substrate back surface 1*a*. The first etching mask 16 is formed, for example, by applying a resist excellent in etching resistance onto the substrate back surface 1*a*, and subjecting the resist to exposure/development. As the resist, for example, a novolak resin derivative or a naphthoquinone diazide derivative can be used. In addition, as a method for applying the resist, for example, a spin coating method, a dip coating method, a spray coating method can be used, but in consideration of uniformity with respect to the flat substrate 1, the spin coating method can be used. As a method of exposing the substrate 1 coated with the resist to a pattern, for example, proximity exposure, projection exposure, stepper exposure can be used. When the pattern is developed, the exposed substrate can be immersed in a developer with the use of, for example, a dipping method, a paddle method, a spray method.

Figure 5C:
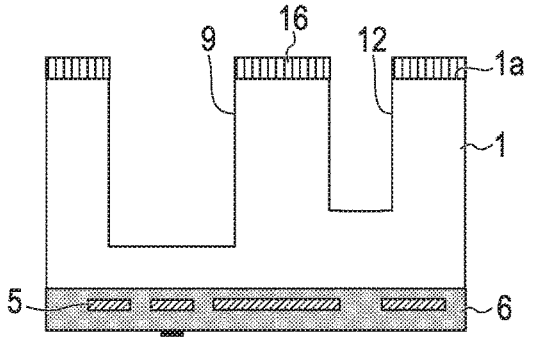

Next, as illustrated in FIG. 5C, the substrate back surface 1*a* is etched with the use of the first etching mask 16, and the first hole 9 and the third hole 12 are formed. As a method of etching the substrate 1, for example, reactive ion etching (RIE), laser processing, crystal anisotropic etching can be used, but in consideration of processing anisotropy and processing accuracy, the RIE can be used. Among the processes, the Bosch process is suitable for forming holes having a high aspect ratio, in which the etching by SF6 gas and a deposition of sidewall protection film by C4F8 gas are alternately performed.

Next, similarly to the case where the first etching mask 16 has been formed, an etching mask for exposing the wiring layer 5 by etching the insulating protective film 6 is formed, then the insulating protective film 6 is dry-etched to be removed, and the wiring layer 5 is exposed.

Figure 5D:
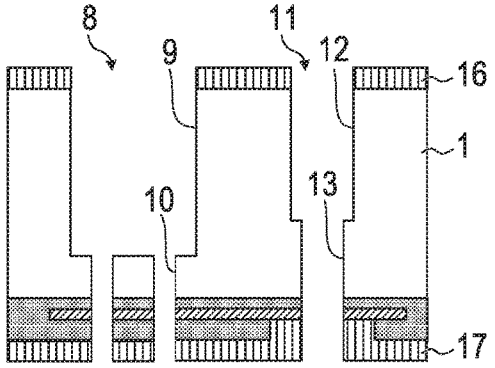

Next, as illustrated in FIG. 5D, the first through hole 8 and the second through hole 11 are formed. Specifically, firstly, a second etching mask 17 for forming the second hole 10 and the fourth hole 13 is formed. Then, the substrate 1 is processed from the substrate surface 1*b* with the use of this second etching mask 17; thereby, the second hole 10 and the fourth hole 13 are formed, and are communicated with the first hole 9 and the third hole 12, respectively; and thereby, the first through hole 8 and the second through hole 11 are formed. At this time, the formation of the second etching mask 17 and the processing of the substrate 1 from the surface 1*b* can be performed similarly to the formation of the first etching mask 16 and the processing of the substrate 1 from the back surface 1*a*.

In addition, when the two holes 9 and 12 are formed in the substrate back surface 1*a*, the holes can be formed by one time of etching by starting the etching simultaneously. In addition, when the two holes 10 and 13 are formed in the substrate surface 1*b*, the holes can be formed by one time of etching by starting the etching simultaneously. When the etching from the substrate back surface 1*a* and the etching from the substrate surface 1*b* each can be performed at one time, the number of steps can be reduced, and the costs of the etching mask and the etching itself can also be reduced. In addition, a method of performing etching from each of the substrate surface 1*b* and the substrate back surface 1*a* can reduce the aspect ratio of the hole to be processed, and is desirable in the point that the etching period of time is shortened and the shape control is facilitated. Generally, the wider the opening width is, the higher the etching rate is. Because of this, by setting the opening widths (minimum widths) of the first to fourth openings 8*a*, 8*b*, 11*a* and 11*b* so as to satisfy relations of D1>D3 and D4>D2, the first and second through holes 8 and 11 each can be penetrated simultaneously. In addition, at this time, the depths L1 to L4 of the first to fourth holes 9, 10, 12 and 13 satisfy a relation of L1/L2≥L3/L4. In addition, "simultaneous" here includes the case where timings deviate from each other due to an in-plane distribution such as a loading effect, in addition to the case where the timings are strictly simultaneous. In this way, the two through holes 8 and 11 having different functions can be formed simultaneously and accurately.

Figure 5E:
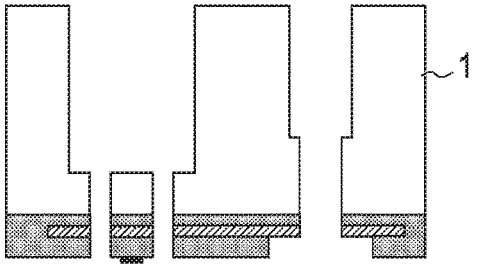

Next, as illustrated in FIG. 5E, the first and second etching masks 16 and 17 are removed. Note that there is the case where reaction products attach to the side wall of the substrate 1, depending on the above processing method of the substrate 1 such as RIE, and accordingly, the reaction products may be removed before or after the process, as needed.

Figure 5F:
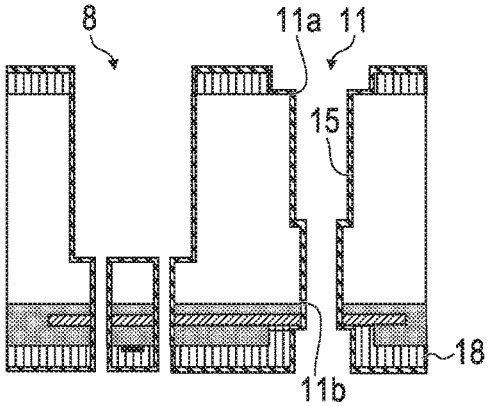

Next, as illustrated in FIG. 5F, an insulating layer mask 18 is formed except the inner surface of the first through hole 8, the inner surface of the second through hole 11, and the vicinity of the third and fourth openings 11*a* and 11*b*; and an insulating layer 15 is formed on a portion exposed from the insulating layer mask 18. As the insulating layer mask 18, a dry filmed resist can be used. The resist is not limited in particular as long as the resist is a resist which can be formed into a dry film, but can be a dry film resist having such a high tenting ability as to be capable of sealing the first through hole 8. As the insulating layer 15, a material is selected which can insulate the through-hole electrode 14 from the substrate 1, and a silicon compound such as SiO or SiN or an oxide such as TiO or AlO can be used. As a method for forming the insulating layer 15, for example, a chemical vapor deposition (CVD) method, an atomic layer deposition (ALD) method, a sputtering method can be used. Among the methods, the ALD method can be used in consideration of the uniformity of a film which is formed on a portion exposed from the insulating layer mask 18. The insulating layer 15 formed on the inner surface of the first through hole 8 functions as a protective film which reduces the dissolution of the inner surface (silicon) of the first through hole 8, due to contact with an alkaline liquid such as ink.

Next, the insulating layer mask 18 is removed by wet processing. The insulating layer 15 formed on the insulating layer mask 18 is lifted off when the insulating layer mask 18 is removed, and is simultaneously removed.

Figure 5G:
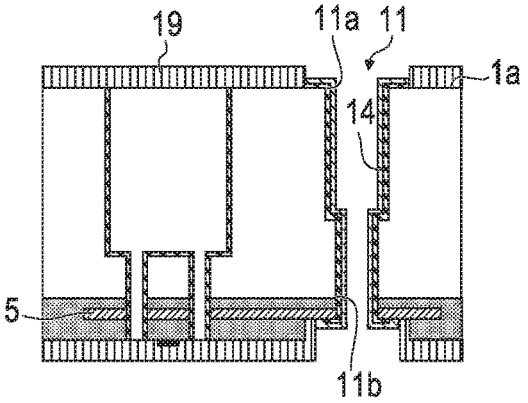

Next, as illustrated in FIG. 5G, the through-hole electrode 14 is formed which electrically connects the wiring layer 5 with the substrate back surface 1*a*. Specifically, an electrode mask 19 is formed except the inner surface of the second through hole 11 and the third and fourth openings 11*a* and 11*b*, and an electrode material to become the through-hole electrode 14 is formed on a portion exposed from the electrode mask 19. The electrode mask 19 can be formed by the same method as that for the above insulating layer mask 18. As the electrode material, a metal is selected which is excellent in electric characteristics and mechanical characteristics, and is wire bondable. Film forming methods for the through-hole electrode 14 include a CVD method, a vacuum sputtering method, a vacuum evaporation, and plating.

Note that when the through-hole electrode 14 is formed by plating, it is necessary to form a seed layer on the inner surface of the second through hole 11 and in the vicinity of the third and fourth openings 11*a* and 11*b*. As a film forming method for the seed layer, a sputtering method or a CVD method can be used. The seed layer can also be formed before the electrode mask 19 is formed. In addition, as the electrode mask 19, a dry film of a resist having resistance to a plating solution can be used.

Figure 5H:
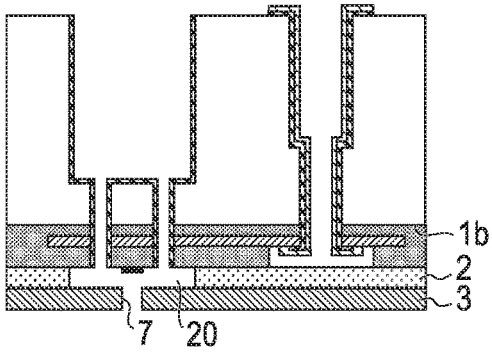

Next, as illustrated in FIG. 5H, the flow path forming member 2 and the ejection port forming member 3 are formed on the side of the substrate surface 1*b*. Specifically, firstly, the electrode mask 19 is removed, and then a dry film resist is transferred to the side of the substrate surface 1*b*. The dry film resist which is used as the flow path forming member 2 can be a negative photosensitive resin. Examples of the negative photosensitive resin include a cyclized polyisoprene containing a bisazide compound, a cresol novolak resin containing azidopyrene, and an epoxy resin containing a diazonium salt or an onium salt. Next, the dry film resist is selectively exposed to light via a photomask, the exposed dry film resist is subjected to heat treatment (PEB), and a cured part and an uncured part are determined. The cured part corresponds to a wall of the flow path of the flow path forming member 2. Next, the ejection port forming member 3 is formed. A method for forming the ejection port forming member 3 is not limited in particular, but a method can be used which uses the transfer of a dry film resist and the photolithography, similarly to the case of the flow path forming member 2, from the viewpoint that the sensitivities of the flow path forming member 2 and the ejection port forming member 3 are adjusted. Thereafter, each of the unexposed parts is dissolved, removed and developed with the use of a liquid which can dissolve the unexposed part (uncured part) of the flow path forming member 2 and the ejection port forming member 3. Thus, the unexposed parts are removed, and thereby the flow path 20 and the ejection port 7 are formed.

As described above, according to the manufacturing method of the present embodiment, two holes 9 and 10 are formed which have different opening widths (minimum widths) D1 and D2 from the back surface 1*a* and the surface 1*b* of the substrate 1, respectively, and by making the holes communicate with each other, a first through hole 8 is formed. Similarly, two holes 12 and 13 are formed which have different opening widths (minimum widths) D3 and D4 from the back surface 1*a* and the surface 1*b* of the substrate 1, respectively, and by making the holes communicate with each other, a second through hole 11 is formed. At this time, in the two holes 9 and 12 which are opened on the back surface 1*a*, the opening widths (minimum widths) D1 and D3 are also configured to be different; and also in the two holes 10 and 13 which are opened on the surface 1*b*, the opening widths (minimum widths) D2 and D4 are configured to be different. Thus, a plurality of through holes 8 and 11 can be formed which have high aspect ratios of different opening diameters. According to such a manufacturing method, the through holes can be simultaneously formed which have the shapes and dimensions suitable for the functions required to each of the through holes, even when the through holes are formed in a substrate with an equal thickness. For this reason, the manufacturing method of the present embodiment is particularly suitable when the thickness of the substrate is thick such as 400 μm or thicker.

Second Embodiment

Figure 6A:
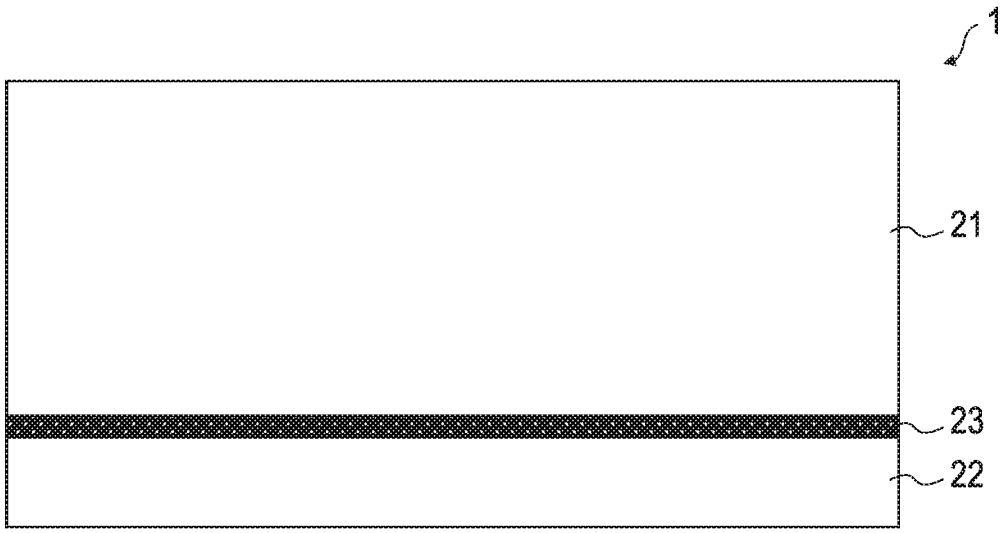
FIGS. 6A and 6B illustrate a schematic cross-sectional view showing a liquid ejection head according to a second embodiment.
Figure 6B:
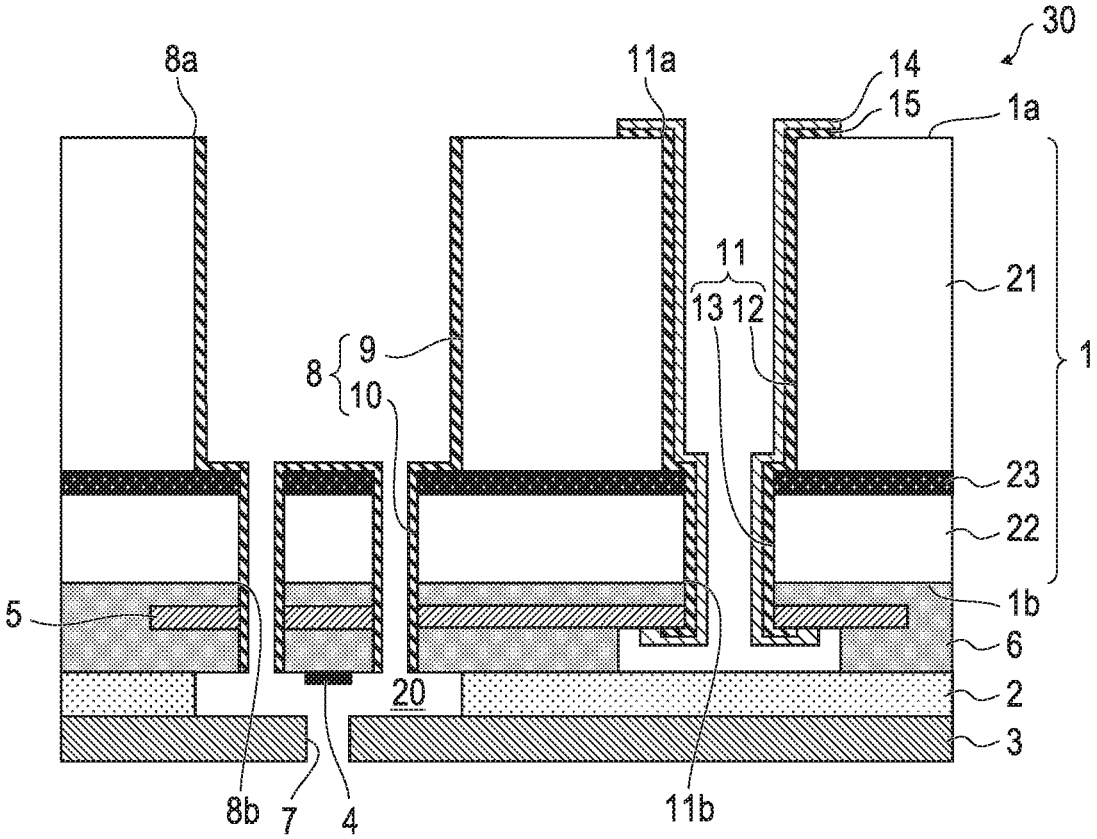

FIG. 6A illustrates a schematic cross-sectional view of a substrate which is used for manufacturing a liquid ejection head according to a second embodiment of the present invention; and FIG. 6B illustrates a schematic cross-sectional view of the liquid ejection head of the present embodiment. Note that the description of the same configuration as that of the liquid ejection head according to the first embodiment will be omitted.

In the present embodiment, as illustrated in FIG. 6A, a substrate 1 is used which includes a first substrate 21 formed from silicon, a second substrate 22 formed from silicon, and an intermediate layer 23 provided between the first substrate 21 and the second substrate 22. The intermediate layer 23 is provided in order to stop the etching of the first hole 9 and the third hole 12 in the first substrate 21, and also stop the etching of the second hole 10 and the fourth hole 13 in the second substrate 22. Materials of the intermediate layer 23 include: resin materials such as photosensitive resin materials; silicon oxide, silicon nitride and silicon carbide; metals other than silicon, or metal oxides or metal nitrides thereof. Among the materials, photosensitive resin layers or a silicon oxide film can be used as the intermediate layer 23, because of being easily formed.

In the case where holes are formed by simultaneously etching patterns having different opening widths, the depths of the holes become different even though the holes have been etched for the same period of time, because the etching rates are different. Furthermore, even though the patterns are same, the depth of the holes is distributed in a wafer plane, due to the density and loading effect in the plane. If the distribution occurs in the depth of the hole, there is a possibility that such a phenomenon occurs that the ejection characteristics of the liquid and the electric characteristics due to the distribution of the film formed for the through-hole electrode result in being different. In order to eliminate such a concern, a silicon oxide film can be further used which is effective as a stopping layer for dry etching, as the above intermediate layer 23. Accordingly, an SOI (Silicon-On-Insulator) substrate can be used as the substrate 1 of the present embodiment.

When the two through holes 8 and 11 are formed with the use of the SOI substrate for the substrate 1, firstly, the first hole 9 and the third hole 12 are formed in the first substrate 21. At this time, a portion (first hole 9) of which the etching rate is high reaches the intermediate layer 23 earlier, due to a micro-loading effect, but the etching is stopped at the intermediate layer 23. Because of this, the depth can be made even with that of a portion (second hole 12) of which the etching rate is low and which reaches the intermediate layer 23 later. Thereafter, the second substrate 22 is etched by a pattern of the second hole 10 and the fourth hole 13, and the etching is similarly stopped at the intermediate layer 23. Then, the intermediate layer 23 between the first hole 9 and the second hole 10 and between the third hole 12 and the fourth hole 13 is removed and penetrated, and thereby the first through hole 8 and the second through hole 11 are formed. Thus, the depth distribution of the hole can be suppressed, and the liquid ejection head 30 can be manufactured of which the shape can be stably controlled. As a substrate other than the SOI substrate, a substrate can also be used which has been formed by forming the first hole 9 and the third hole 12 in the first substrate 21, forming the second hole 10 and the fourth hole 13 in the second substrate 22, and then bonding the substrates via an adhesive.

EXAMPLE

The present invention will be described in more detail below with reference to a specific example.

In the present example, the through-hole electrode 14 was formed in the substrate 1 by the manufacturing method illustrated in FIGS. 5A to 5H, and the wiring resistance was measured.

Firstly, in the step illustrated in FIG. 5A, the energy generating element 4 and the wiring layer 5 were formed on the surface 1*b* of the substrate 1 formed from silicon, and films of SiO and SiN were formed thereon by a plasma CVD method to form an insulating protective film 6. Thereafter, an adhesion layer (not shown) made from a polyether amide resin was formed on the insulating protective film 6. The thickness of the formed adhesion layer was 2 μm.

Next, in the step illustrated in FIG. 5B, a photoresist (trade name "iP 5700" (produced by Tokyo Ohka Kogyo Co., Ltd.) was applied onto the substrate back surface 1*a* so as to become 7 μm, by spin coating. Then, the applied photoresist was exposed to a pattern of the first hole 9 of which the opening shape is a rectangle with 200 μm×20 mm and the third hole 12 of which the opening shape is a circle with a diameter of 115 μm, with the use of a projection exposure apparatus (trade name "UX-4258", manufactured by USHIO INC.), with a light exposure of 400 mJ/cm$^2$. Thereafter, the resultant photoresist was developed with the use of an aqueous solution of 2.38% tetramethyl hydroxide (trade name "NMD-3", produced by Tokyo Ohka Kogyo Co., Ltd.), and a first etching mask 16 was formed.

Next, in the step illustrated in FIG. 5C, the substrate back surface 1*a* was subjected to an anisotropic etching for 60 minutes, by the Bosch process with the use of a silicon dry etching apparatus (trade name "Pegasus", manufactured by SPP Technologies Co. Ltd.), and the first hole 9 and the third hole 12 were formed. The central value of the depth of the first hole 9 was 475 μm, and the central value of the depth of the third hole 12 was 395 μm.

Next, in the step illustrated in FIG. 5D, a second etching mask 17 was formed on the substrate surface 1*b* side, which had a pattern of the circular second hole 10 with a diameter of 40 μm and the circular fourth hole 13 with a diameter of 80 μm, by the same forming method as that for the first etching mask 16. Thereafter, SiO and SiN of the exposed insulating protective film 6 were etched with the use of a dry etching apparatus (trade name "APS", manufactured by SPP Technologies Co. Ltd.), and the wiring layer 5 was exposed. Furthermore, the substrate surface 1*b* was subjected to the anisotropic etching for 60 minutes with the use of the silicon dry etching apparatus, similarly to the etching of the substrate back surface 1*a* side, thereby, the second hole 10 and the fourth hole 13 were formed, and the holes were made to communicate with the first hole 9 and the third hole 12, respectively. The central value of the depth of the second hole 10 was 150 μm, and the central value of the depth of the fourth hole 13 was 235 μm.

Next, in the step illustrated in FIG. 5E, the above obtained substrate was immersed in a stripping liquid (trade name "EKC2255", produced by EKC Technology Limited) at 60° C. for 30 minutes, and the etching masks 16 and 17 and a reaction product in the Bosch process were removed, which was deposited on the inner surfaces of the through holes 8 and 11.

Next, in the step illustrated in FIG. 5F, a tented dry film resist (trade name "PMER CY-1000", produced by Tokyo Ohka Kogyo Co., Ltd.) was patterned on the front and back surfaces 1*a* and 1*b* of the substrate 1, and the insulating layer 15 was formed on the inner surfaces of the first through hole 8 and the second through hole 11. A resist was transferred to the substrate 1 by a transfer apparatus (trade name "VTM-200", manufactured by Takatori Corporation), and was exposed and developed to form patterns having opening diameters 60 μm larger than the opening diameter (opening width) of the third and fourth openings 11*a* and 11*b*, respectively, and an insulating layer mask 18 with a thickness of 30 μm was obtained. Then, an AlO film having a thickness of 300 nm was formed in the substrate 1 by an ALD apparatus (manufactured by Picosun Japan Co. Ltd.), while trimethyl aluminum was used as a precursor. Furthermore, the resist and the AlO film formed on the resist were removed by dipping treatment using a stripping liquid (trade name "EKC2255", produced by EKC Technology Limited). Thus, the insulating layer 15 was formed only on the inner surface of the first through hole 8, the inner surface of the second through hole 11, and on the vicinity of the third and fourth openings 11*a* and 11*b*.

Next, in the step illustrated in FIG. 5G, plating masks were formed which had opening diameters 100 μm larger than the opening diameters (opening width) of the third and fourth openings 11*a* and 11*b*, respectively, by the same forming method as that for the insulating layer mask 18. Thereafter, titanium and copper films were formed from the front and back surfaces 1*a* and 1*b* of the substrate 1 so that the film thicknesses of the respective surfaces become 400 nm and 500 nm, with the use of a sputtering apparatus (trade name "SDH 10311", manufactured by Shinko Seiki Co., Ltd.) to form a seed layer. Then, the above obtained substrate was subjected to electroless copper plating for 20 minutes at 60° C. in an electroless copper plating solution (trade name "Epitus PHP", produced by C.Uemura & Co., Ltd.), and a copper plating layer having a thickness of approximately 1.7 μm was formed on the inner surface of the second through hole 11. The mask was removed with a stripping liquid (trade name "MICROPOSIT REMOVER 1112A", produced by Rohm and Haas Electronic Materials Co., Ltd.), and then, copper of the seed layer was removed by etching by a mixed acid (trade name "Cu-30", produced by Kanto Chemical Co., Ltd.). Then, titanium of the seed layer was removed by etching by a buffered hydrofluoric acid (trade name "110U", produced by Daikin Industries, Ltd.), and the through-hole electrode 14 was formed which was electrically connected to the wiring layer 5.

The wiring resistance of the through-hole electrode 14 at this time was 0.0408Ω. On the other hand, the through-hole electrode was formed in the same procedure as that described above except that the hole diameter of the second through hole was constant (85 μm) in the depth direction, and the wiring resistance was 0.0478Ω. Accordingly, it was confirmed that the wiring resistance of the through-hole electrode can be reduced by approximately 15% in the present example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-195929, filed Oct. 17, 2018, which is hereby incorporated by reference herein in its entirety.

What is claimed is:

1. A liquid ejection head comprising:

a substrate having a first plane and a second plane on an opposite side of the first plane;

an ejection port forming member that is provided on a side of the second plane of the substrate and has an ejection port formed therein which ejects a liquid therethrough; and a wiring layer provided between the substrate and the ejection port forming member, wherein in the substrate, a first through-hole and a second through-hole are formed to penetrate through the substrate, the first through-hole constituting a supply path which communicates with the ejection port and supplies the liquid to the ejection port, and a through-hole electrode, which is electrically connected to the wiring layer, is formed on an inner surface of the second through-hole, wherein the first through-hole has a first hole which has a first opening in the first plane, and a second hole which has a second opening in the second plane and communicates with the first hole, wherein the second through-hole has a third hole which has a third opening in the first plane, and a fourth hole which has a fourth opening in the second plane and communicates with the third hole, and wherein when a minimum width of the first opening along a straight line which passes through a center of the first opening and is parallel to the first plane is represented by D1, a minimum width of the second opening along a straight line which passes through a center of the second opening and is parallel to the second plane is represented by D2, a minimum width of the third opening along a straight line which passes through a center of the third opening and is parallel to the first plane is represented by D3, and a minimum width of the fourth opening along a straight line which passes through a center of the fourth opening and is parallel to the second plane is represented by D4, the first to fourth openings satisfy a relation of:

D1>D3>D4>D2, and the through-hole electrode is formed continuously on sidewall surfaces of the third hole and the fourth hole so as to extend from the third opening to the fourth opening.

2. The liquid ejection head according to claim 1, wherein a first angle formed by an inner surface of the first hole and the first plane, a second angle formed by an inner surface of the second hole and the second plane, a third angle formed by an inner surface of the third hole and the first plane, and a fourth angle formed by an inner surface of the fourth hole and the second plane are each a right angle or an obtuse angle.

3. The liquid ejection head according to claim 2, wherein the third angle and the fourth angle are both right angles.

4. The liquid ejection head according to claim 3, wherein the third opening has a peripheral length equal to or longer than a circumference that has the minimum width D3 as a diameter, and the fourth opening has a peripheral length equal to or longer than a circumference that has the minimum width D4 as a diameter.

5. The liquid ejection head according to claim 4, wherein the third opening is a square that has the minimum width D3 as a length of one side, and the fourth opening is a square that has the minimum width D4 as a length of one side.

6. The liquid ejection head according to claim 4, wherein the third hole is formed into a cylindrical shape, and the fourth hole is formed into a cylindrical shape coaxial with the third hole.

7. The liquid ejection head according to claim 6, wherein when a depth of the third hole is represented by L3, a depth of the fourth hole is represented by L4, a resistivity of the through-hole electrode is represented by ρ, a thickness of the through-hole electrode is represented by t, and a radius of the second through-hole is represented by r, a virtual cone is defined by a vertex angle of 2θ and is an extension of a circular truncated cone defined by a circle having the minimum width D3 as a diameter as a bottom face and a circle having the minimum width D4 as a diameter as a top face, the circular truncated cone being extended beyond a side of the top face to define the virtual cone, a distance between a vertex of the virtual cone and the top face is represented by H1, a distance between the vertex and the bottom face is represented by H2, and a distance from the vertex along a perpendicular drawn from the vertex to the bottom face is represented by H, and the depths, the resistivity, the thickness, the radius, the minimum widths, the vertex angle and the distances satisfy a relation of:

$$\int_{H1}^{H2} \frac{4\rho dH}{\pi[(2H\tan\theta)^2 - 4(H\tan\theta - t)^2]} < \rho\frac{L3}{\pi t(D3 - t)} + \rho\frac{L4}{\pi t(D4 - t)} + \int_{\frac{dD3}{2}-t}^{\frac{D4}{2}-t} \frac{\rho dr}{2\pi rt}.$$

8. The liquid ejection head according to claim 2, wherein the first angle and the second angle are both right angles.

9. The liquid ejection head according to claim 1, wherein when a depth of the first hole is represented by L1, a depth of the second hole is represented by L2, a depth of the third hole is represented by L3, and a depth of the fourth hole is represented by L4, the depths satisfy a relation of L1/L2≥L3/L4.

10. The liquid ejection head according to claim 1, wherein the substrate includes a first substrate, a second substrate, and an intermediate layer provided between the first substrate and the second substrate; the first hole and the third hole are formed in the first substrate; and the second hole and the fourth hole are formed in the second substrate and the intermediate layer.

11. The liquid ejection head according to claim 1, wherein the first hole is formed into a groove shape on the first plane, and a plurality of the second holes are formed on a bottom face of the first hole.

12. The liquid ejection head according to claim 1, wherein a thickness of the substrate is 400 μm or greater.

13. The liquid ejection head according to claim 1, further comprising a flow path allowing the ejection port to communicate with the supply path, wherein a liquid inside the flow path is circulated between the flow path and an outside.

14. A method for manufacturing the liquid ejection head according to claim 1, comprising:

forming the first hole and the third hole in the substrate from a side of the first plane; and after having formed the first hole and the third hole, forming the second hole and the fourth hole in the substrate from a side of the second plane.

15. The method for manufacturing the liquid ejection head according to claim 14, wherein the first hole and the third hole are simultaneously formed, and the second hole and the fourth hole are simultaneously formed.

16. The method for manufacturing the liquid ejection head according to claim 14, wherein the first hole and the third hole are formed by reactive ion etching, and the second hole and the fourth hole are formed by reactive ion etching.

* * * * *